US007975867B1

(12) United States Patent
Turner

(10) Patent No.: US 7,975,867 B1
(45) Date of Patent: Jul. 12, 2011

(54) WAITER'S DISH CADDY

(76) Inventor: Laderra Turner, Los Angeles, CA (US)

( * ) Notice: Subject to any disclaimer, the term of this patent is extended or adjusted under 35 U.S.C. 154(b) by 364 days.

(21) Appl. No.: 12/137,172

(22) Filed: Jun. 11, 2008

Related U.S. Application Data

(60) Provisional application No. 60/992,570, filed on Dec. 5, 2007.

(51) Int. Cl.
*B65D 6/08* (2006.01)

(52) U.S. Cl. ..... 220/487; 211/41.2

(58) Field of Classification Search ..... 220/486, 220/487, 495, 572; 211/41.2, 41.4, 85.31, 211/126.9, 133.5, 181.1; 294/137, 413, 161
See application file for complete search history.

(56) References Cited

U.S. PATENT DOCUMENTS 1,556,384 A * 10/1925 Vehling et al. ..... 312/244
1,723,551 A * 8/1929 Linares ..... 312/294
1,888,141 A * 11/1932 Orth ..... 211/41.2
7,267,308 B1 * 9/2007 Jenson ..... 248/176.1

* cited by examiner

*Primary Examiner* — Harry A Grosso
(74) *Attorney, Agent, or Firm* — Kenneth L Tolar

(57) ABSTRACT

A dish caddy includes a base frame formed of multiple, tiered circular racks with vertical support rods attached to the periphery thereof. Each rack includes a wedge-shaped notch formed on its periphery. Superimposed on an upper end of the base frame is a dome-shaped cover having a handle attached thereto. To transport multiple plates to a table, a waiter places each plate on one of the tiered racks and grasps the handle with either hand. The frame is then transported to the table where the waiter can easily remove and serve each plate.

4 Claims, 1 Drawing Sheet

WAITER'S DISH CADDY

CROSS REFERENCE TO RELATED APPLICATIONS

This application is entitled to the benefit of provisional application No. 60/992,570 filed on Dec. 5, 2007, the specification of which is incorporated herein by reference.

BACKGROUND OF THE INVENTION

The present invention relates to a device that allows a meal server to easily transport multiple dishes from a kitchen to a table.

DESCRIPTION OF THE PRIOR ART

A waiter often transports multiple dishes to one or more tables using a large, circular tray. The waiter usually positions the tray on a tray jack that is erected adjacent to the table being served. The jack is not only obtrusive, but is cumbersome to erect, particularly if done by the waiter handling the food tray. Additionally, the handling of food trays usually causes numerous accidents. The only viable alternative is for food runners to carry individual plates, which is strenuous and wastes costly manpower. Accordingly, there is currently a need for an easier, more convenient means of transporting multiple dishes from a kitchen to a dining table.

A review of the prior art reveals a myriad of devices for simultaneously storing and/or transporting multiple dishes or trays. For example, U.S. Pat. No. 2,845,183 issued to Paulsen discloses a pie rack including a plurality of tiered rings for retaining pie plates, which are interconnected with vertical rods. The upper ends of the rods form a handle that can be covered with a transparent sheet.

U.S. Pat. No. 3,168,229 issued to Heifetz discloses a plate holder including a cylindrical basket having a longitudinal opening for receiving a stack of dishes.

U.S. Pat. No. 5,064,236 issued to Stanfield discloses a dish carrier including a base panel and a top panel with a plurality of slidable stanchions disposed therebetween. The stanchions may be repositioned to straddle plates of varying diameters.

U.S. Pat. No. 4,838,596 issued to Stanfield discloses a dish carrier including a base plate having a plurality of slots extending inwardly from its periphery toward the center. Arms are positioned within the slots to retain varying size dishes positioned on the base plate.

U.S. Pat. No. 4,923,236 issued to Bunck discloses a food receptacle carrier including a plurality of tiered discs, each for supporting a food receptacle. Two opposing arcuate closures are pivotally attached to the circumference of one of the disks which provide selective access to the food receptacles.

U.S. Pat. No. 2,448,319 issued to Maranville discloses a pie or cake carrier including a plurality of interconnected, tiered racks with a handle extending from an uppermost rack.

Although numerous dish carriers exist in the prior art, none of the above-described patents disclose a carrier having tiered racks superimposed on a drip pan and disposed between support rods, all of which are enclosed within an attached dome-shaped cover, wherein each rack includes a peripheral notch. The uniquely designed dish caddy according to the present invention provides the unobvious advantage of allowing a waiter to conveniently and simultaneously transport multiple dishes each having hot, ready-to-serve food items thereon, as explained in more detail below.

SUMMARY OF THE INVENTION

A dish caddy includes a base frame formed of multiple, tiered circular racks with vertical support rods attached to the periphery thereof. Each rack includes a wedge-shaped notch formed on a peripheral edge. Superimposed on an upper end of the base frame is a dome-shaped cover having a handle attached thereto. To transport multiple plates to a table, a waiter places each plate on one of the tiered racks and grasps the handle with either hand. The frame is transported to the table where the waiter can easily remove and serve each plate.

It is therefore an object of the present invention to provide a device that allows a food server to quickly and conveniently transport multiple dishes to a table.

It is another object of the present invention to eliminate the burden and inconvenience associated with serving multiple diners.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
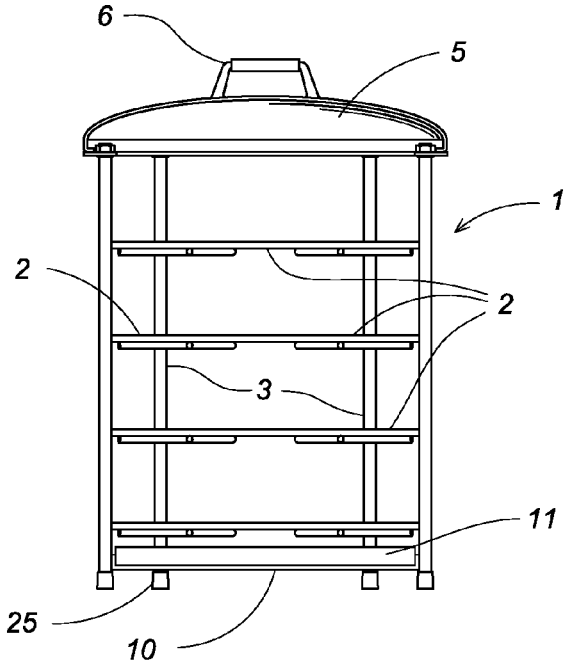
FIG. 1 is a front, plan view of the dish caddy according to the present invention.
Figure 2:
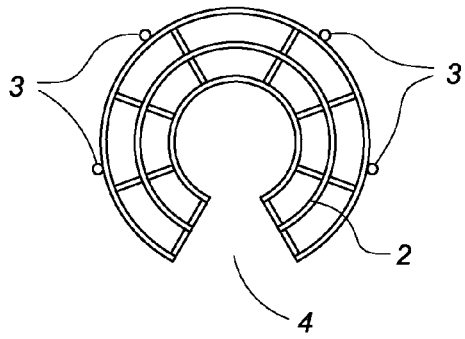
FIG. 2 is a top, plan view of an exemplary rack.
Figure 3:
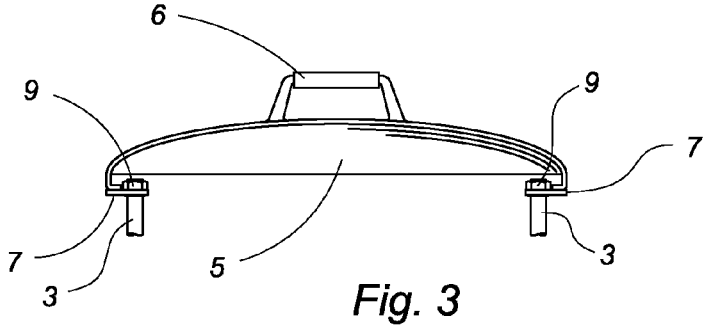
FIG. 3 is a side view of the cover.
Figure 4:
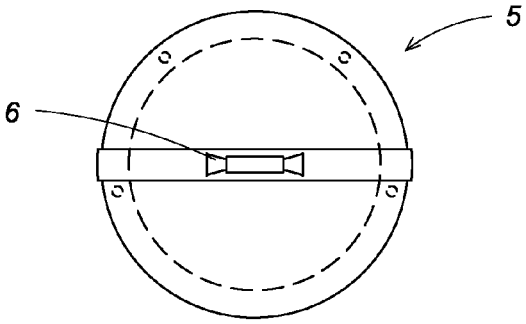
FIG. 4 is a top view of the cover.
Figure 5:
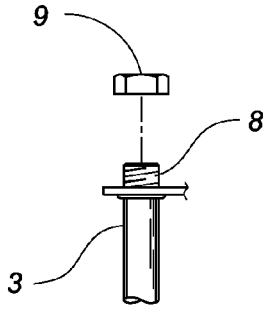
FIG. 5 is a detailed, cutaway view of a support rod and associated fastening nut.

A dish caddy includes a base frame 1 formed of multiple, tiered circular racks 2 with vertical support rods 3 attached to the periphery thereof. A lower end of each rod includes a rubber foot 25 for protecting an underlying surface. Each rack includes a wedge-shaped notch 4 formed on its peripheral edge. Superimposed on an upper end of the base frame is a dome-shaped cover 5 having a handle 6 attached thereto. The cover includes a plurality of peripherally-disposed brackets 7 each having an aperture thereon for receiving the upper threaded end 8 of one of the support rods. A nut 9 fastens to the threaded end to secure each support rod to the cover. A support tray 10 is positioned a minimal distance beneath a lowermost rack for accommodating a drip pan 11.

To transport multiple plates to a table, a waiter places each plate on one of the tiered racks and grasps the handle with either hand. The frame is transported to the table where the waiter can easily remove each plate and place it on the dining table. The wedge-shaped notches assure that the waiter can easily position a hand (and an overlying protective cloth or pot holder) beneath the plate prior to lifting. The drip pan collects any errant food particles that may fall from a plate during transport or removal. Meanwhile, the dome-shaped cover provides a steam shield during transport to prevent burning of the waiter's hand and also maintains the hot food items at a desired temperature.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A dish caddy comprising:

a base frame formed of multiple, tiered racks interconnected with vertical support rods, each rack having a peripheral edge with a wedge-shaped notch formed thereon that assures that a waiter can easily position a hand beneath a plate when said plate is resting on one of said racks;

a dome-shaped cover superimposed on an upper end of the base frame for protecting a carrier from steam emanating from the plate resting on said rack;

a plurality of brackets peripherally-disposed on said cover, each of said brackets having an aperture thereon;

each of said support rods including an upper, threaded end that extends through the aperture on one of said brackets, said threaded end having a nut threadedly fastened thereto to secure each support rod to the cover.

2. The dish caddy according to claim 1 further comprising:

a support tray positioned a minimal distance beneath a lowermost rack and attached to said support rods;

a drip pan resting on said support tray for collecting errant food from said plate.

3. The dish caddy according to claim 2 wherein said cover includes a handle attached thereto.

4. The dish caddy according to claim 3 wherein each of said rods further includes a lower end having a rubber foot mounted thereon for minimizing damage to an underlying surface.

* * * * *